US009662881B2

(12) United States Patent
Nakayama et al.

(10) Patent No.: US 9,662,881 B2
(45) Date of Patent: May 30, 2017

(54) LIQUID EJECTING HEAD

(71) Applicant: SEIKO EPSON CORPORATION, Tokyo (JP)

(72) Inventors: Masao Nakayama, Shiojiri (JP); Eiju Hirai, Minowa-machi (JP); Toshihiro Shimizu, Fujimi-machi (JP); Motoki Takabe, Shiojiri (JP); Yasuhiro Itayama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/057,558

(22) Filed: Mar. 1, 2016

(65) Prior Publication Data

US 2016/0257119 A1 Sep. 8, 2016

(30) Foreign Application Priority Data

Mar. 3, 2015 (JP) ..... 2015-041542

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1629* (2013.01); *B41J 2/1632* (2013.01); *B41J 2/1646* (2013.01); *B41J 2202/03* (2013.01); *B41J 2202/11* (2013.01)

(58) Field of Classification Search
CPC ..... B41J 2/14233
See application file for complete search history.

(56) References Cited

U.S. PATENT DOCUMENTS

2008/0018716 A1* 1/2008 Noguchi ..... B41J 2/14233 347/71
2014/0267508 A1* 9/2014 Ohashi ..... B41J 2/14233 347/70

FOREIGN PATENT DOCUMENTS

JP 2005-260003 A 9/2005

* cited by examiner

*Primary Examiner* — Alessandro Amari
*Assistant Examiner* — Roger W Pisha, II
(74) *Attorney, Agent, or Firm* — Foley & Lardner LLP

(57) ABSTRACT

A liquid ejecting head includes a piezoelectric element that is disposed on a flow passage formation substrate, and discharges liquid from nozzle openings through the nozzle openings by pressurizing the liquid which fills the inside of a pressure generating chamber due to the displacement of a vibration film according to driving of the piezoelectric element, the piezoelectric element includes an insulating film formed on the vibration film, a first electrode film formed on the insulating film, a piezoelectric layer formed on the first electrode film, and a second electrode film formed on the piezoelectric layer, and the insulating film includes a lower insulating film formed on the vibration film and an upper insulating film which is formed on the lower insulating film with the same material as that of the lower insulating film, but has a different crystal structure.

9 Claims, 7 Drawing Sheets

LIQUID EJECTING HEAD

BACKGROUND

1. Technical Field

The present invention relates to a liquid ejecting head, and particularly, to a liquid ejecting head which is a useful for realizing high density of a piezoelectric element.

2. Related Art

A piezoelectric element, which is displaced by applying a voltage, is mounted on, for example, a liquid ejecting head ejecting liquid droplets, or the like. As such a liquid ejecting head, for example, a recording head of an ink jet type (hereinafter, also referred to as recording head) is known, in which a part of a pressure generating chamber communicating with a nozzle opening is formed of a vibration film. In addition, the recording head discharges the ink droplets from nozzle openings by pressurizing ink which fills an inside of the pressure generating chamber in which the vibration film is deformed due to the piezoelectric element.

In this type of the recording head, in order to accomplish displacement of the vibration film when realizing a high-density of the piezoelectric element disposed on an insulating film, for example, an insulating film formed as a zirconia film needs to be thin.

JP-A-2005-260003 discloses a technology for improving characteristics of the piezoelectric layer by controlling the surface roughness of the zirconia film when regulating a film formation condition of the zirconia film, which is the insulating film.

FIG. 8 is a graph illustrating a correlation of the surface roughness Ra of the insulating film and (100) alignment ratio of a piezoelectric layer (PZT) crystal. As illustrated in the drawing, the crystal becomes good when the alignment ratio of the piezoelectric layer increases as a numerical value of the surface roughness Ra also increases. It suggests that the insulating film can be thin while controlling the crystal properties of the piezoelectric layer when the surface roughness Ra increases. That is, when the insulating film can be realized to be thin, the displacement thereof according to driving of the piezoelectric element can be great.

However, as disclosed in JP-A-2005-260003, the surface roughness Ra is less likely to be controlled using only a film formation condition of the insulating film (zirconia film), and the crystal properties of the piezoelectric layer is less likely to be improved. That is, in a technology of the related art disclosed in JP-A-2005-260003, or the like, a film thickness of the insulating film needs to be thin in order to realize a high density of the piezoelectric element; however, the surface roughness Ra is not increased when the film thickness thereof becomes thin, and the alignment ratio of the piezoelectric layer becomes small. Therefore, the film thickness of the insulating film is required to be large.

SUMMARY

An advantage of some aspects of the invention is to provide a liquid ejecting head including a piezoelectric element, which makes an insulating film thin while controlling the crystal properties of the piezoelectric layer.

According to an aspect of the invention, there is provided a liquid ejecting head including a piezoelectric element that is disposed on a flow passage formation substrate, and discharging liquid from nozzle openings through the nozzle openings by pressurizing the liquid which fills an inside of a pressure generating chamber due to displacement of a vibration film according to driving of the piezoelectric element, in which the piezoelectric element includes an insulating film formed on the vibration film, a first electrode film formed on the insulating film, a piezoelectric layer formed on the first electrode film, and a second electrode film formed on the piezoelectric layer, and the insulating film includes a lower insulating film formed on the vibration film and an upper insulating film which is formed on the lower insulating film with the same material as that of the lower insulating film, but has a different crystal structure.

In this case, the insulating film is configured to have the lower insulating film which is formed on the vibration film and the upper insulating film which is formed on the lower insulating film. Moreover, the upper insulating film is made of the same material as that of the lower insulating film but has a different crystal structure, and thus the surface roughness Ra of the insulating film can be increased. As a result, the alignment ratio of the piezoelectric layer formed on the insulating film can be increased through the first electrode film, and the insulating film can be thin while controlling the crystal properties of the piezoelectric layer. Therefore, the displacement according to driving of the piezoelectric element can be significantly increased.

In the liquid ejecting head, the lower insulating film may be formed by a sputtering method, and the upper insulating film may be formed by a liquid-phase method. The lower insulating film formed by the sputtering method is formed as columnar particles, and spreading of Pb from the piezoelectric layer may be appropriately suppressed. Meanwhile, the upper insulating film formed by the liquid-phase method may be formed as small-diameter particles, and have a low Young's modulus, so that the crystal properties of the piezoelectric layer can be improved.

In the liquid ejecting head, the upper insulating film preferably is formed to have a film thickness within a range of 50 nm to 100 nm. The lower insulating film preferably is formed to have a film thickness within a range of 20 nm to 50 nm, and the insulating film preferably is formed to have a film thickness within a range of 100 nm to 150 nm. Accordingly, the film thickness of the insulating film can be formed to be thin up to substantially 125 nm compared to substantially 400 nm thickness thereof in the related art.

In the liquid ejecting head, the surface roughness Ra on the upper insulating film preferably is equal to or more than 0.7 nm. Accordingly, a great surface roughness Ra is obtained, and the alignment properties of the piezoelectric layer can be 90%, or more. In addition, yttrium of 10% or less preferably is added to the upper insulating film which is formed by the liquid-phase method. Stabilization of the crystal of the upper insulating film can be realized.

BRIEF DESCRIPTION OF THE DRAWINGS

The invention will be described with reference to the accompanying drawings, wherein like numbers reference like elements.

DESCRIPTION OF EXEMPLARY EMBODIMENT

Hereinafter, the invention will be described in detail based on an embodiment.

Figure 1:
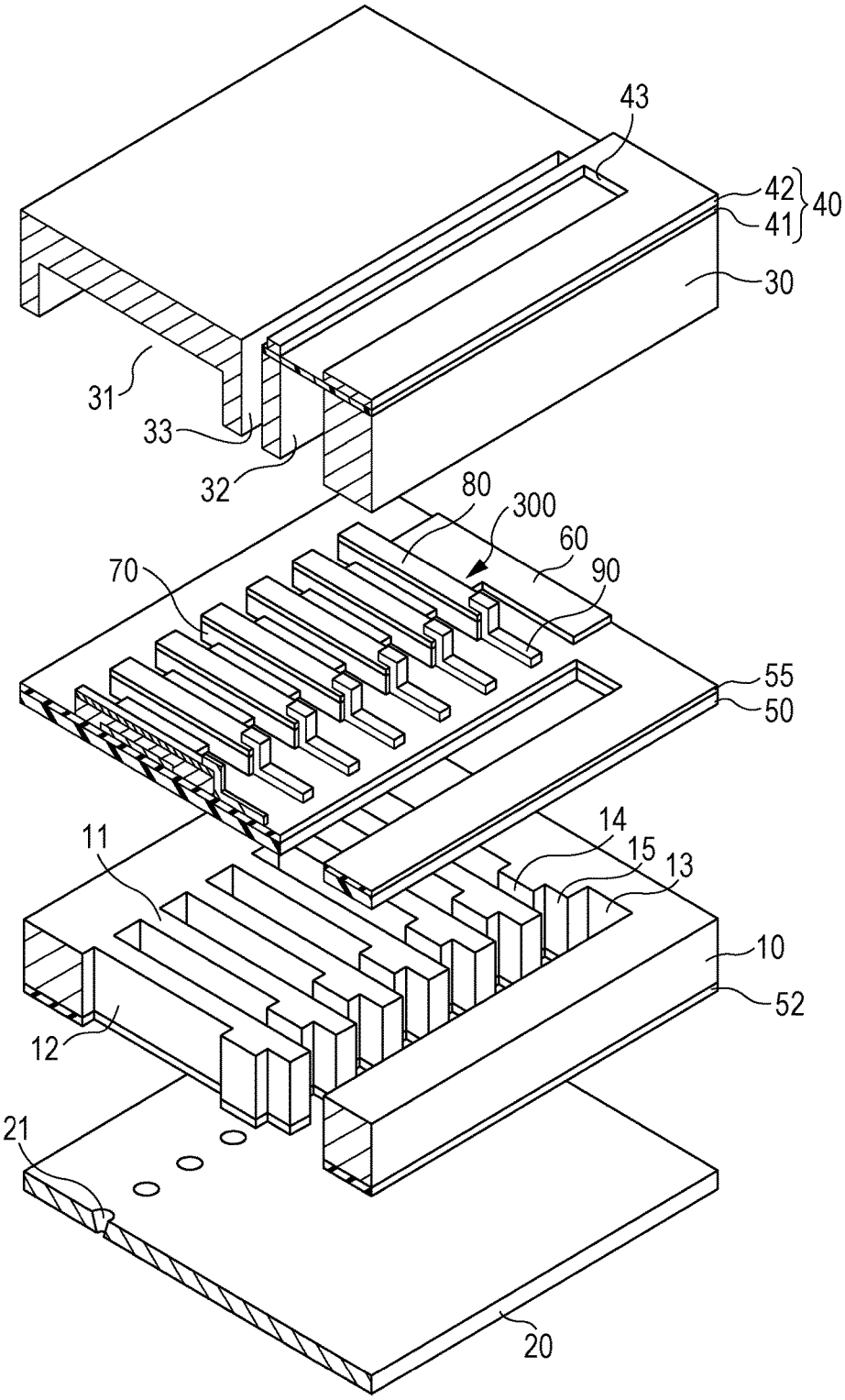
FIG. 1 is an exploded perspective view of a recording head according to an embodiment.
Figure 2A:
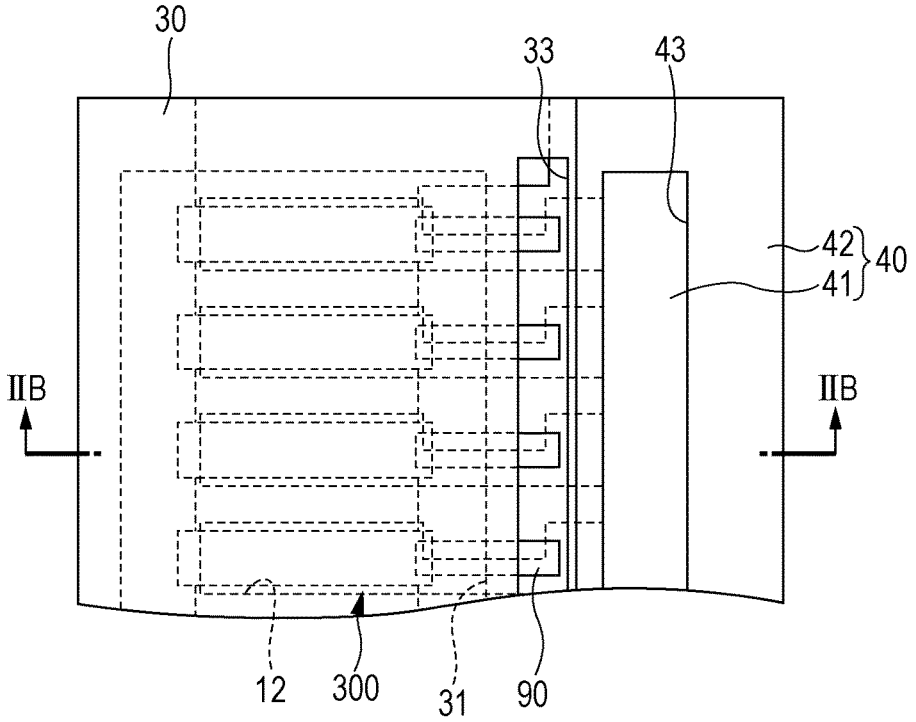
FIGS. 2A and 2B are respectively a plan view and a sectional view of the recording head according to the embodiment.
Figure 2B:
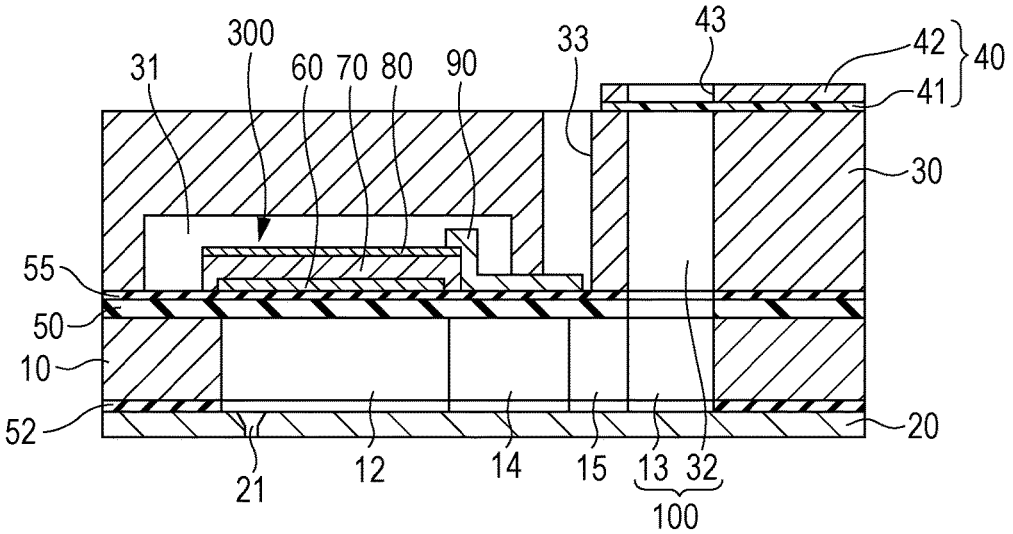

FIG. 1 is an exploded perspective view illustrating a recording head of an ink jet type according to the embodiment of the invention, and FIGS. 2A and 2B are respectively a plan view and a sectional view of FIG. 1. As illustrated in FIG. 1 to FIG. 2B, a flow passage formation substrate 10 is formed of a silicon single crystal substrate of an alignment (110) in the embodiment, and a vibration film 50, which is formed of a silicon dioxide made by thermal oxidization in advance, is formed on one surface of the flow passage formation substrate. In the flow passage formation substrate 10, a plurality of pressure generating chambers 12, which are formed by an anisotropic etching from the other surface side thereof and are divided by partition walls 11, are arranged in a width direction thereof. In addition, a communication portion 13 is formed in a region outside of a longitudinal direction of the pressure generating chamber 12 of the flow passage formation substrate 10, and the communication portion 13 and each of the pressure generating chamber 12 communicate with each other through ink supply passages 14 which are respectively formed in each of the pressure generating chamber 12. Moreover, the communication portion 13 constitutes a part of a manifold which is a common ink chamber of the pressure generating chamber 12 by communicating with a manifold portion of a protective substrate to be described later. The ink supply passage 14 is formed with a width narrower than the pressure generating chamber 12, and a flow passage resistance of ink, which flows from the communication portion 13 to the pressure generating chamber 12, is constantly maintained.

In addition, the nozzle plate 20 in which nozzle openings 21, which communicates near an end portion on an opposite side of the ink supply passage 14 of each pressure generating chamber 12, are perforated, is fixed in an opening surface side of the flow passage formation substrate 10 through a mask film to be described later using an adhesive, heat welding film, or the like. Also, the nozzle plate 20 has a thickness of, for example, 0.01 mm to 1 mm, and linear expansion coefficient thereof is 300° C. or less. The nozzle plate is formed of, for example, a glass ceramic which is 2.5 to 4.5[$\times 10^{-6}$/° C.], the silicon single crystal substrate, stainless steel, or the like.

Figure 8:
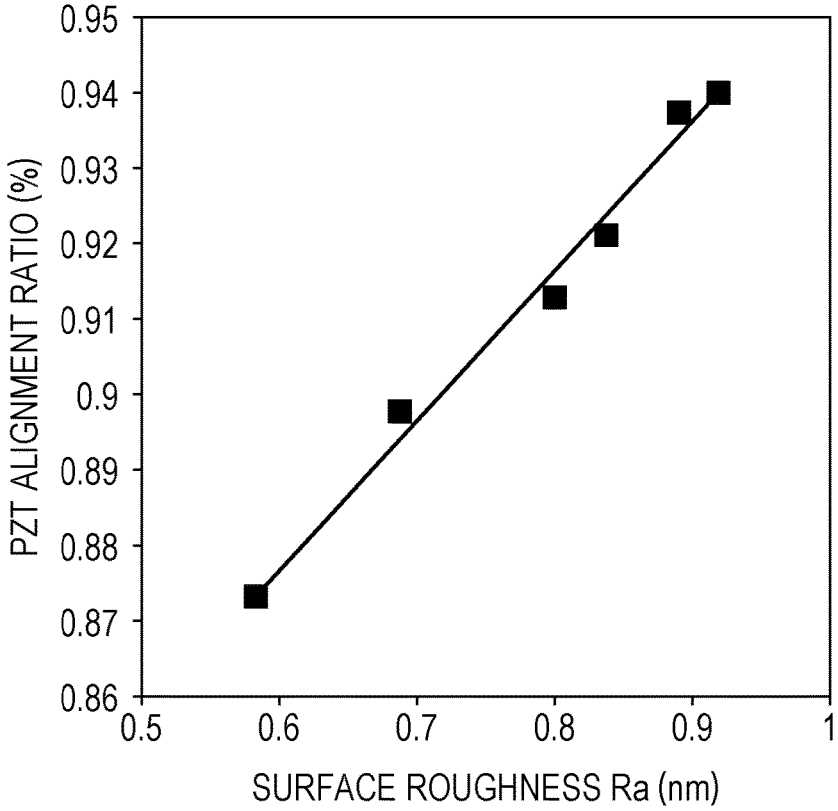
FIG. 8 is a graph illustrating a correlation of a roughness of the insulating film and an alignment ratio of a piezoelectric layer.

Meanwhile, as described above, for example, a vibration film 50 which is formed of the silicon dioxide ($SiO_2$) having substantially 0.5 μm thickness is formed on the opposite side of the opening surface side of the flow passage formation substrate 10, and an insulating film 55 which is formed of zirconium oxide ($ZrO_2$) are formed on the vibration film 50. The insulating film 55 in the embodiment is a film of two layers structure in which a lower insulating film and an upper insulating film are included. The lower insulating film is formed on the vibration film 50, and an upper insulating film is formed on the lower insulating film with the same material as that of the lower insulating film, but has a different crystal structure. The insulating film 55 is formed by being over-coated with the same material (zirconium in the embodiment) as that of the insulating film 55 in a liquid-phase method. In this case, the surface roughness Ra of the insulating film 55 which is over-coated by the liquid-phase method is preferably 0.7 nm or more and less than 3 nm. When the surface roughness Ra is set to 0.7 nm or more, as illustrated in FIG. 8, an alignment ratio of a piezoelectric layer 70 can be 90% or more. In addition, as seen from the above, it is preferable that yttrium of 10% or less is added to the insulating film 55 formed by the liquid-phase method. This process is performed in order to stabilize the crystal of the insulating film 55.

Figure 3:
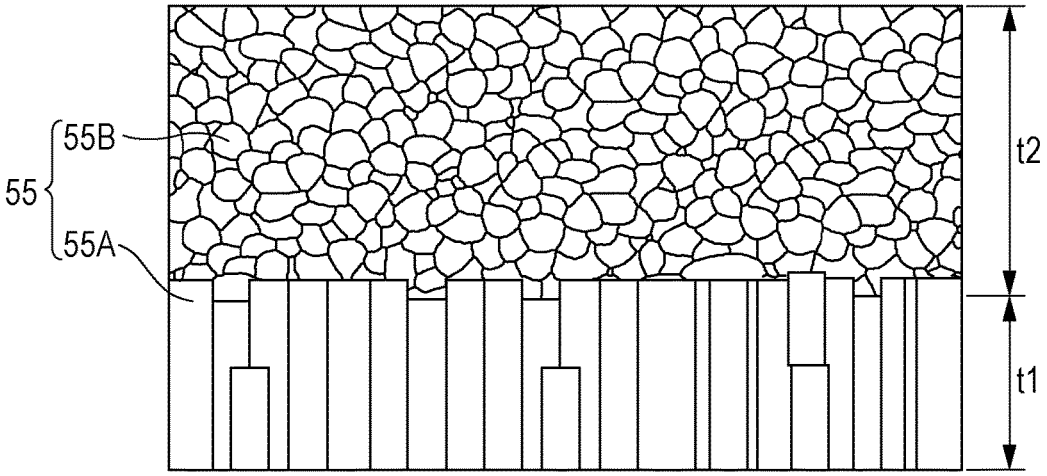
FIG. 3 is a schematic view illustrating two layers of an insulating film having different crystal structures.

The insulating film 55 in the embodiment as described above is formed by over-coating a zirconium film which is the same material as that of the insulating film 55 in the liquid-phase method. As a result, as schematically illustrated in FIG. 3, the insulating film 55 in the embodiment includes the two-layer structure in which a lower insulating film 55A and an upper insulating film 55B are included. The lower insulating film 55A is formed on the vibration film 50 (for example, refer to FIG. 1), and the upper insulating film 55B is formed on the lower insulating film 55A. Also, in the embodiment, the lower insulating film 55A is formed by a sputtering method, and the upper insulating film 55B is formed by a liquid-phase method.

As a result, the lower insulating film 55A formed by the sputtering method includes the crystal structure in which columnar particles are densely aggregated so as to be capable of appropriately suppressing spreading of Pb from the piezoelectric layer 70. Meanwhile, the upper insulating film 55B formed by the liquid-phase method can be a flexible film having a low Young's modulus, which includes a crystal structure in which small-diameter particles are sparsely aggregated. Here, these films are formed so that a relationship of a film thickness t1 of the lower insulating film 55A≤a film thickness t2 of the upper insulating film 55B is satisfied.

Here, the film thickness of the insulating film 55 is formed within a range of 100 nm to 150 nm. More details, the film thickness of the upper insulating film 55B is formed within a range of 50 nm to 100 nm as a reference value of 70 nm, and the film thickness of the lower insulating film 55A is formed within a range of 20 nm to 50 nm. Therefore, the lower insulating film 55A and the upper insulating film 55B are formed so that a total film thickness of both is within a range of 100 nm to 150 nm as a reference value of 125 nm. Accordingly, in the related art, the film thickness of the insulating film 55 which is substantially 400 nm can be thin to become substantially 125 nm.

Moreover, in the embodiment, a film which is formed by the sputtering method is referred to as the lower insulating film 55A, and a film which is formed by the liquid-phase method is referred to as the upper insulating film 55B; however, because of a relationship thereof, as described above, both of a merit of a film formation in the sputtering method and a merit of a film formation in the liquid-phase method can be obtained. However, a vertical relationship between the lower insulating film 55A and the upper insulating film 55B is not necessarily limited to the embodiment. It does not matter when the vertical relationship may be reversed. In short, the insulating film 55 may include the two-layer structure in which the lower insulating film and the upper insulating film, which is formed on the lower insulating film with the same material as that of the lower insulating film but has a different crystal structure, are formed.

On the insulating film 55, a piezoelectric element 300 is formed in which a first electrode film 60 which is a lower electrode film, the piezoelectric layer 70, and a second electrode film 80 which is an upper electrode film are multilayered by a process to be described later. Here, the piezoelectric element 300 is a part which includes the first electrode film 60, the piezoelectric layer 70, and the second electrode film 80. In general, an electrode in any one of the piezoelectric element 300 is set to a common electrode, and an electrode in the other thereof and the piezoelectric layer 70 are formed in each of the pressure generating chambers 12 by patterning. Also, here, a part, which is configured to have any patterned electrode and the piezoelectric layer 70, so that a piezoelectric strain is generated due to applying of the voltage to both electrodes, is set to a piezoelectric active portion. In the embodiment, the first electrode film 60 is set to a common electrode of the piezoelectric element 300, and the second electrode film 80 is set to an individual electrode of the piezoelectric element 300; however, it does not matter when these films are reversed because of setting of driving circuits or wires. In any case, the piezoelectric active portion is formed in each of the pressure generating chambers 12. In addition, in the embodiment, the vibration film 50, the insulating film 55, and the first electrode film 60 function as a vibration plate.

In addition, lead electrodes 90 are respectively connected to each of the second electrode films 80 of the piezoelectric elements 300, and a voltage is selectively applied to each of the piezoelectric elements 300 through the lead electrodes 90.

In addition, in a surface of the piezoelectric element 300 side on the flow passage formation substrate 10, a protection substrate 30 including a piezoelectric element holding portion 31 is bonded to a region facing the piezoelectric element 300 using an adhesive. The piezoelectric element 300 is formed in the piezoelectric element holding portion 31 so as to be protected in a state in which an external circumstance does not have an influence thereon. Further, in the protection substrate 30, a manifold portion 32 is provided on a region corresponding to the communication portion 13 of the flow passage formation substrate 10. In the embodiment, the manifold portion 32 is formed in a juxtaposing direction of the pressure generating chamber 12 by communicating with the protection substrate 30 in a thickness direction in the embodiment, and constitutes a manifold 100 which is a common ink chamber of each of the pressure generating chamber 12 by penetrating the communication portion 13 of the flow passage formation substrate 10 as described above.

In a region between the piezoelectric element holding portion 31 and the manifold portion 32 of the protection substrate 30, a through hole 33 which penetrates the protection substrate 30 in a thickness direction is provided, and a part of the first electrode film 60 and a tip end portion of the lead electrode 90 in the through hole 33 are exposed. It is not illustrated; however, the other end of a connection wire in which one end thereof, which is connected to a driving IC, is connected to the first electrode film 60 and the lead electrode 90.

Moreover, as a material of the protection substrate 30, for example, a glass, a ceramic material, a metal, a resin, and the like are exemplified, but the protection substrate 30 is more preferably made of a material having a thermal expansion ratio thereof substantially similar to that of the flow passage formation substrate 10. In the embodiment, the protection substrate 30 is formed of a silicon single crystal substrate which is the same material as that of the flow passage formation substrate 10.

In addition, a compliance substrate 40, which is configured to have a sealing film 41 and a fixing plate 42, is bonded onto the protection substrate 30. The sealing film 41 is made of a material having flexibility and low rigidity (for example, polyphenylene sulfide (PPS) film having 6 μm thickness), and one surface of the manifold portion 32 is sealed with the sealing film 41. In addition, the fixing plate 42 is made of a hard material such as a metal (for example, stainless steel (SUS) having 30 μm thickness, or the like). Since a region facing the manifold 100 of the fixing plate 42 is an opening portion 43 which is completely removed in a thickness direction, one surface of the manifold 100 is sealed with only the sealing film 41 having flexibility.

The recording head of an ink jet type of the embodiment discharges ink by processes as follows: an inside thereof is filled with the ink throughout from the manifold 100 to the nozzle opening 21 after absorbing the ink from an external ink supplying unit which is not illustrated; in response to a recording signal from the driving IC which is not illustrated, a voltage is applied between each of the first electrode films 60 and the second electrode films 80 corresponding to the pressure generating chamber 12; and the vibration film 50, the insulating film 55, the first electrode film 60, and the piezoelectric layer 70 are bent and deformed. Therefore, the pressure inside the pressure generating chamber 12 is increased, and the ink is discharged from the nozzle opening 21.

Hitherto, according to the recording head of the embodiment, the insulating film 55 is configured to have the lower insulating film 55A formed on the vibration film 50 and the upper insulating film 55B formed on the lower insulating film 55A, in addition, the upper insulating film 55B is made of the same material as that of the lower insulating film 55A but has a different crystal structure, thereby making it possible to increase the surface roughness Ra of the insulating film 55. As a result, the alignment ratio of the piezoelectric layer 70 formed on the insulating film 55 can be increased through the first electrode film 60, and thus the insulating film 55 can be made thin while controlling the crystal properties of the piezoelectric layer 70. For this reason, displacement is significantly increased according to driving of the piezoelectric element.

Figure 4A:
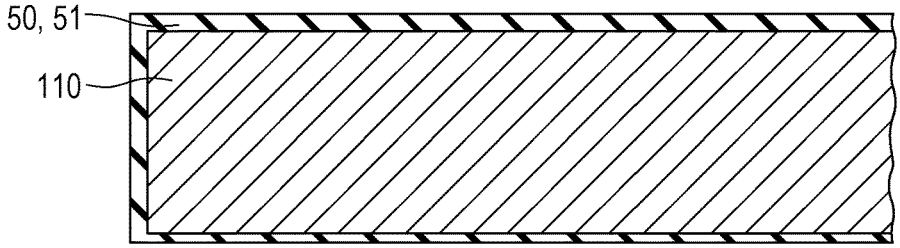
FIGS. 4A, 4B, 4C, and 4D are sectional views illustrating a manufacturing process of the recording head according to the embodiment.

Next, a manufacturing method of the recording head of an ink jet type described above (hereinafter, also referred to as recording head) will be described with reference to FIG. 4A to FIG. 7. Moreover, FIG. 4A to FIG. 7 are sectional views of the pressure generating chamber 12 taken along the longitudinal direction. First, as illustrated in FIG. 4A, a wafer 110 for flow passage formation substrate which is a silicon wafer is thermally oxidized at substantially 1100° C. of a diffusion furnace, and the silicon dioxide film 51 constituting the vibration film 50 is formed on a surface thereof. Moreover, in the embodiment, as the flow passage formation substrate 10, a silicon wafer having a relatively great film thickness of substantially 625 μm and a relatively high rigidity is used.

Figure 4B:
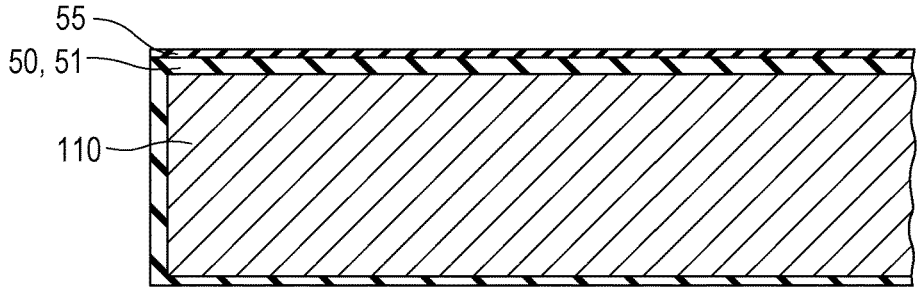

Next, as illustrated in FIG. 4B, the insulating film 55 made of zirconium oxide is formed on the vibration film 50 (silicon dioxide film 51). Specifically, a zirconium (Zr) layer is formed on the vibration film 50 (silicon dioxide film 51). Subsequently, the insulating film 55 which is made of a zirconium oxide is formed by thermally oxidizing the zirconium layer. The insulating film 55 in the embodiment is formed as a film having two-layer structure in which the lower insulating film 55A and the upper insulating film 55B are included. The lower insulating film 55A is formed on the vibration film 50 as described above, and the upper insulating film 55B is formed on the lower insulating film 55A with the same material as that of the lower insulating film 55A but has a different crystal structure.

Figure 4C:
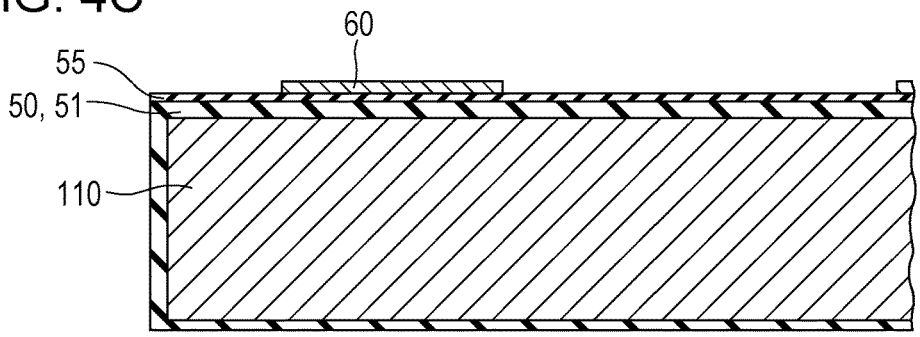

Next, as illustrated in FIG. 4C, for example, the first electrode film 60 which is made of at least platinum and iridium is formed on the entire surface of the insulating film 55 by the sputtering method, or the like, and then the first electrode film 60 is patterned into a predetermined shape. Moreover, the surface roughness Ra of the first electrode film 60 depends on the surface roughness Ra of the insulating film 55. In the embodiment, the insulating film 55 is configured to have the two-layer structure so as to increase the surface roughness Ra, and thus, alignment properties of the piezoelectric layer 70 formed on the first electrode film 60 can be reliably maintained.

Figure 4D:
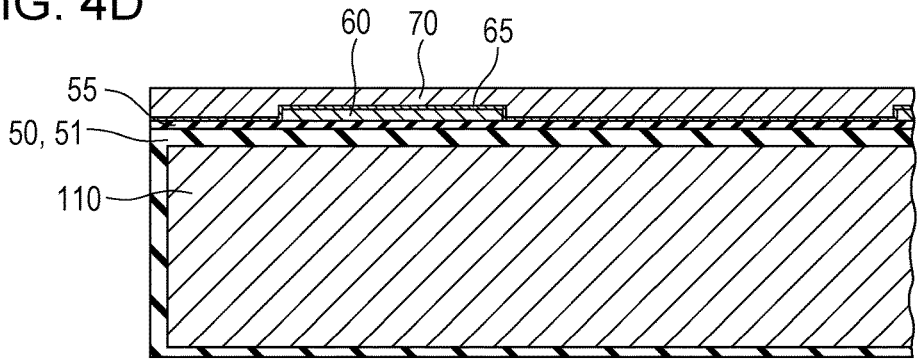

Next, as illustrated in FIG. 4D, titanium (Ti) is applied on the first electrode film 60 and the insulating film 55 twice or more by the sputtering method, for example, a DC sputtering method (applied twice in the embodiment), and thus, a continuous type titanium seed layer 65 having a predetermined thickness is formed. The titanium seed layer 65 is preferably formed with a film thickness which is within a range of 1 nm to 8 nm. When the titanium seed layer 65 is formed to have such a thickness as described above, the crystal properties of the piezoelectric layer 70, which is formed in a process to be described later, can be improved.

Next, for example, the piezoelectric layer 70 which is made of a lead zirconate titanate (PZT) is formed on the titanium seed layer 65 formed as described above. In the embodiment, the piezoelectric layer 70 made of a metal oxide is obtained by applying and drying a so-called sol, which is obtained by dissolving and dispersing an organic metal material, and gelling the resultant, and further firing the resultant at a high temperature. Therefore, the piezoelectric layer 70 made of PZT is formed by a so-called sol-gel method.

Figure 5A:
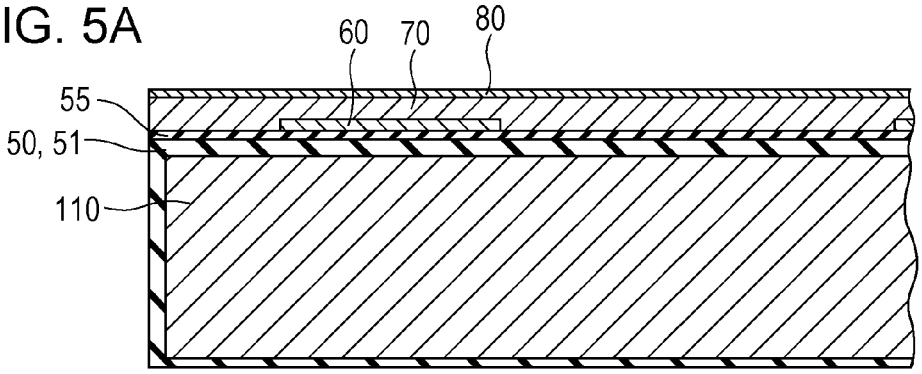
FIGS. 5A, 5B, and 5C are sectional views illustrating the manufacturing process of the recording head according to the embodiment.
Figure 5B:
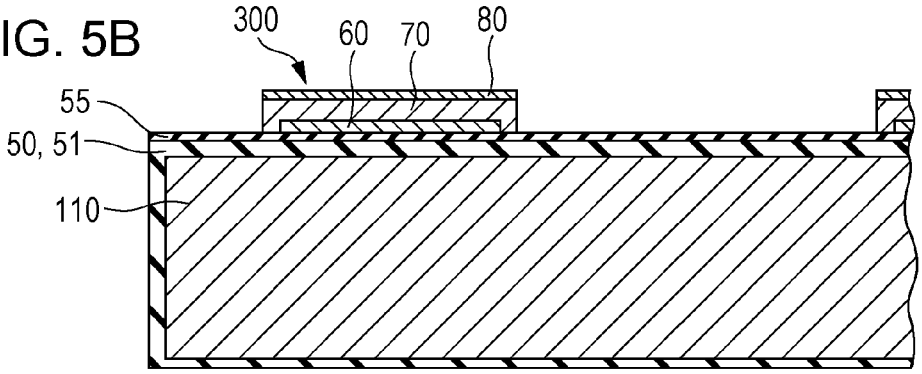
Figure 5C:
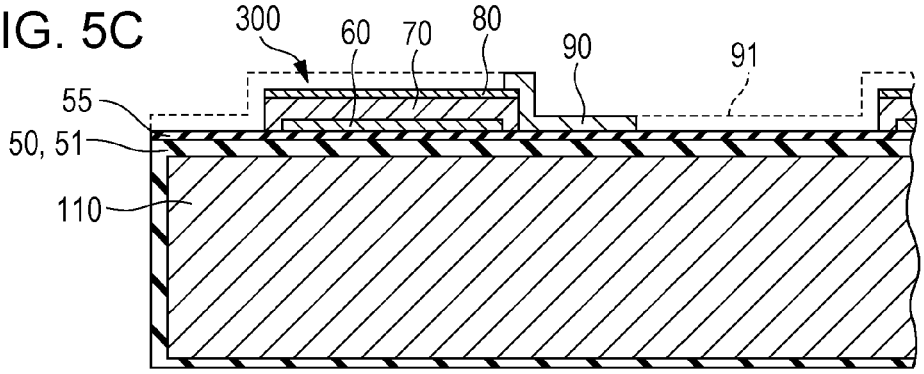

After forming the piezoelectric layer 70, as illustrated in FIG. 5A, for example, the second electrode film 80 made of iridium is formed on the entire surface of the wafer 110 for flow passage formation substrate. Subsequently, as illustrated in FIG. 5B, the piezoelectric element 300 is formed by patterning the piezoelectric layer 70 and the second electrode film 80 on a region facing each of the pressure generating chambers 12. Next, the lead electrode 90 is formed. Specifically, as illustrated in FIG. 5C, for example, a metal layer 91 made of gold (Au), or the like is formed throughout the entire surface of the wafer 110 for flow passage formation substrate. After that, the lead electrode 90 is formed by patterning the metal layer 91 in each of the piezoelectric elements 300 for example, through a mask pattern made of a resist, or the like (not illustrated).

Figure 6A:
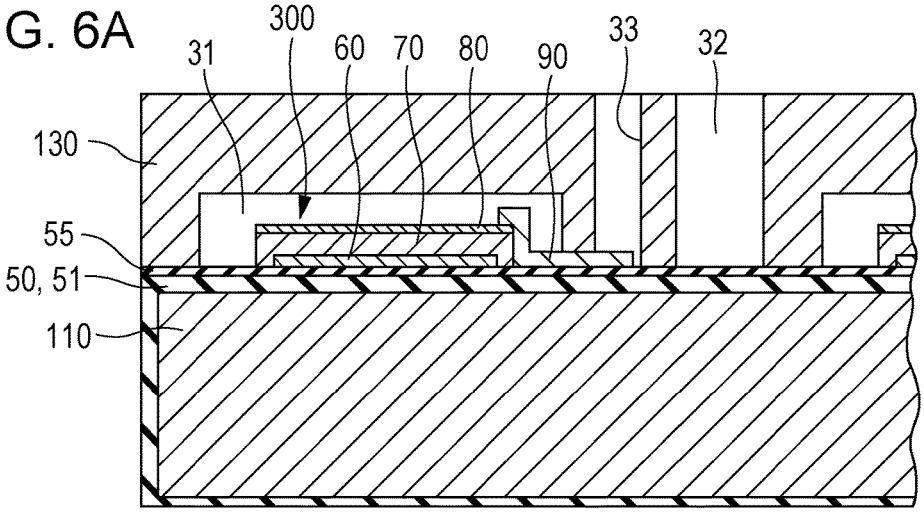
FIGS. 6A, 6B, and 6C are sectional views illustrating the manufacturing process of the recording head according to the embodiment.

Next, as illustrated in FIG. 6A, a wafer 130 for protection substrate, which is a silicon wafer and functions as a plurality of the protection substrates 30, is bonded to the piezoelectric element 300 side of the wafer 110 for flow passage formation substrate. Moreover, the wafer 130 for protection substrate has a thickness of, for example, substantially 400 μm, and thus, the rigidity of the wafer 110 for flow passage formation substrate is significantly improved by being bonded to the wafer 130 for protection substrate.

Figure 6B:
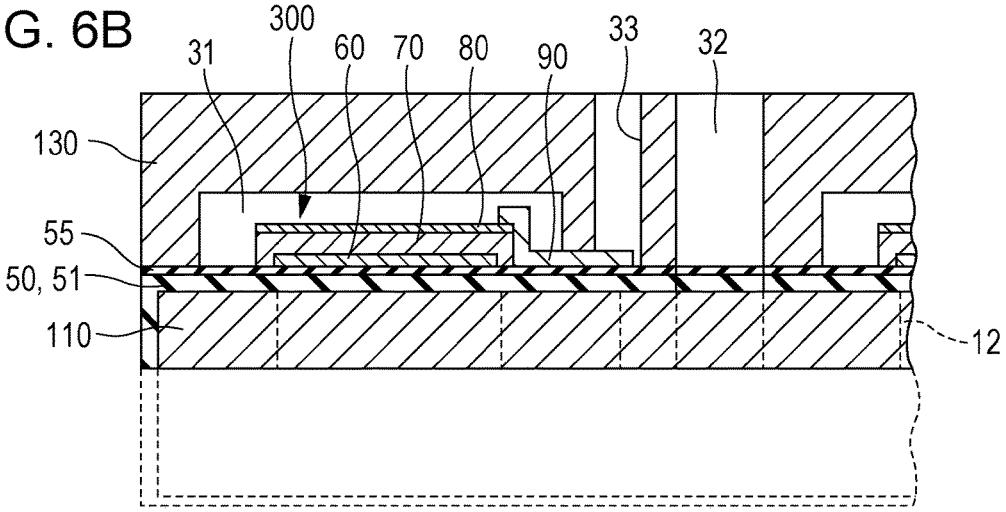

Next, as illustrated in FIG. 6B, after the wafer 110 for flow passage formation substrate is ground to have some thickness, and is further wet-etched using nitrohydrofluoric acid, therefore, the wafer 110 for flow passage formation substrate becomes a predetermined thickness. For example, in the embodiment, the wafer 110 for flow passage formation substrate is etched so as to have a thickness of substantially 70 μm.

Figure 6C:
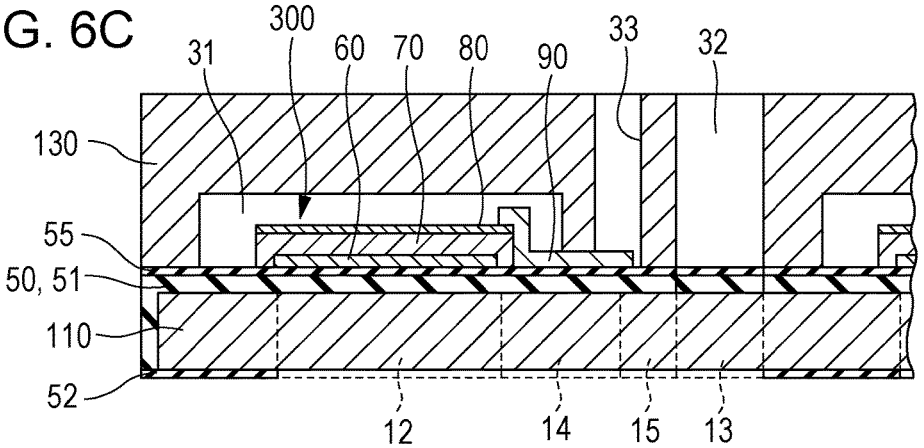
Figure 7:
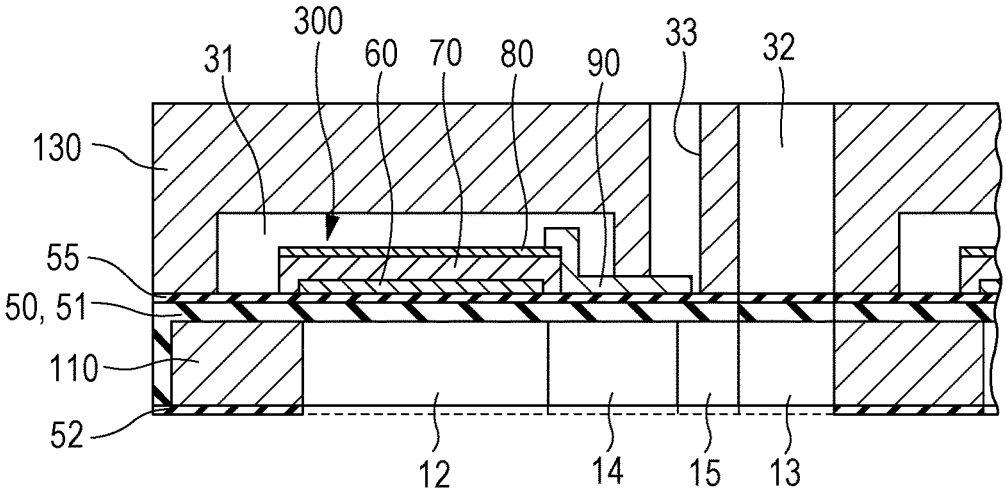
FIG. 7 is sectional view illustrating the manufacturing process of the recording head according to the embodiment.

Next, as illustrated in FIG. 6C, for example, the mask film 52 made of silicon nitride (SiN) is newly formed on the wafer 110 for flow passage formation substrate, and is patterned to be a predetermined shape. Also, an anisotropic etching is performed on the wafer 110 for flow passage formation substrate through the mask film 52, and as illustrated in FIG. 7, the pressure generating chamber 12, the communication portion 13, the ink supply passage 14, and the like are formed on the wafer 110 for flow passage formation substrate.

After that, an unnecessary portion of an outer circumference edge portion of the wafer 110 for flow passage formation substrate and the wafer 130 for protection substrate is cut so as to be removed, for example, by dicing. Also, the nozzle plate 20 in which the nozzle opening 21 is perforated is bonded to a surface opposite to the wafer 130 for protection substrate of the wafer 110 for flow passage formation substrate, and the compliance substrate 40 is bonded to the wafer 130 for protection substrate 130. Then, the wafer 110 for flow passage formation substrate, or the like is divided into the flow passage formation substrate 10, or the like of a size of one chip as illustrated in FIG. 1, and thus the recording head of an ink jet type in the embodiment is made.

Other Embodiment

Hitherto, one embodiment of the invention is described; however, the invention is not limited to the embodiment described above. For example, in the embodiment described above, as an example of a head using a liquid ejecting apparatus, the recording head of an ink jet type is exemplified; however, the invention is widely used for general liquid ejecting heads, and can be applied to an apparatus which ejects liquid other than the ink, of course. As the others except the liquid ejecting head, for example, there are various recording heads used for an image recording apparatus such as a printer, color material ejecting heads used for manufacturing color filters such as liquid crystal display, electrode material ejecting heads used for forming electrodes of an organic EL display, a field emission display (FED), and the like, bio-organic material ejecting heads used for manufacturing bio chips, and the like. In addition, the invention can be used for not only an actuator which is mounted on the liquid ejecting head (recording head of ink jet type) as a liquid discharging unit, but also for actuator apparatus mounted on all apparatuses. For example, an actuator apparatus can be used for the heads described above, and also used for sensors, and the like.

What is claimed is:

1. A liquid ejecting head comprising:

a flow passage formation substrate defining a pressure generating chamber, the pressure generating chamber being configured to hold a liquid;

a piezoelectric element that is disposed on the flow passage formation substrate;

a vibration film; and an insulating film formed on the vibration film, wherein the liquid ejecting head is configured to discharge the liquid from at least one nozzle opening by pressurizing the liquid in the pressure generating chamber due to displacement of the vibration film according to driving of the piezoelectric element, wherein the piezoelectric element includes a first electrode film formed on the insulating film, a piezoelectric layer formed on the first electrode film, and a second electrode film formed on the piezoelectric layer, wherein the insulating film includes a lower insulating film formed on the vibration film, and an upper insulating film formed on the lower insulating film, wherein the lower and upper insulating films are formed of the same material, wherein the lower insulating film is a film formed by a sputtering method, and the upper insulating film is a film formed by a liquid-phase method, such that the lower and upper insulating films have different crystal structures, and wherein a thickness of the upper insulating film formed by the liquid-phase method is greater than a thickness of the lower insulating film formed by the sputtering method.

2. The liquid ejecting head according to claim 1, wherein the upper insulating film is formed to have a film thickness within a range of 50 nm to 100 nm.

3. The liquid ejecting head according to claim 1, wherein the lower insulating film is formed to have a film thickness within a range of 20 nm to 50 nm, and the insulating film is formed to have a film thickness within a range of 100 nm to 150 nm.

4. The liquid ejecting head according to claim 1, wherein the surface roughness Ra on the upper insulating film is equal to or more than 0.7 nm.

5. The liquid ejecting head according to claim 1, wherein the upper insulating film includes yttrium, and an amount of the yttrium in the upper insulating film is 10% or less.

6. A liquid ejecting head comprising:

a flow passage formation substrate defining a pressure generating chamber, the pressure generating chamber being configured to hold a liquid;

a piezoelectric element that is disposed on the flow passage formation substrate, a vibration film; and an insulating film formed on the vibration film, wherein the liquid ejecting head is configured to discharge the liquid from at least one nozzle opening by pressurizing the liquid in the pressure generating chamber due to displacement of the vibration film according to driving of the piezoelectric element, wherein the piezoelectric element includes a first electrode film formed on the insulating film, a piezoelectric layer formed on the first electrode film, and a second electrode film formed on the piezoelectric layer, wherein the insulating film includes a lower insulating film formed on the vibration film and an upper insulating film formed on the lower insulating film, wherein the lower and upper insulating films are formed of the same material, wherein the lower insulating film is a film formed by a sputtering method, and the upper insulating film is a film formed by a liquid-phase method, such that the lower and upper insulating films have different crystal structures, and wherein the upper insulating film includes yttrium, and an amount of the yttrium in the upper insulating film is 10% or less.

7. The liquid ejecting head according to claim 6, wherein the upper insulating film is formed to have a film thickness within a range of 50 nm to 100 nm.

8. The liquid ejecting head according to claim 6, wherein the lower insulating film is formed to have a film thickness within a range of 20 nm to 50 nm, and the insulating film is formed to have a film thickness within a range of 100 nm to 150 nm.

9. The liquid ejecting head according to claim 6, wherein the surface roughness Ra on the upper insulating film is equal to or more than 0.7 nm.

* * * * *